US006210116B1

(12) United States Patent
Kuczaj et al.

(10) Patent No.: US 6,210,116 B1
(45) Date of Patent: Apr. 3, 2001

(54) HIGH EFFICIENCY PUMP IMPELLER

(76) Inventors: John E. Kuczaj, 16370 Benmar Dr., Roseville, MI (US) 48066; Dong Chul Oh, 18184 Manorwood North, Clinton Township, MI (US) 48038

( * ) Notice: Subject to any disclaimer, the term of this patent is extended or adjusted under 35 U.S.C. 154(b) by 0 days.

(21) Appl. No.: 09/285,416

(22) Filed: Apr. 2, 1999

Related U.S. Application Data

(60) Provisional application No. 60/107,195, filed on Nov. 5, 1998.

(51) Int. Cl.[7] ..... F04D 29/38

(52) U.S. Cl. ..... 416/185; 416/186 R; 416/198 R; 416/223 B; 416/228

(58) Field of Search ..... 416/182, 185, 416/186 R, 198 R, 223 B, 228

(56) References Cited

U.S. PATENT DOCUMENTS 4,025,225 * 5/1977 Durant ..... 415/90
4,253,798 * 3/1981 Sugiura ..... 415/213 R
4,255,081 * 3/1981 Oklejas et al. ..... 415/90
4,280,791 * 7/1981 Gawne ..... 415/90
5,192,183 * 3/1993 Wilkinson ..... 415/90
5,427,503 * 6/1995 Haraga et al. ..... 416/223 B
5,741,118 * 4/1998 Shinbara et al. ..... 416/186 R

* cited by examiner

*Primary Examiner*—Edward K. Look
*Assistant Examiner*—Ninh Nguyen
(74) *Attorney, Agent, or Firm*—John R. Benefiel

(57) ABSTRACT

An improved pump impeller using both spaced disc stack and radial vanes to establish pumping, the vanes separated to form a circumferential array of convergent spaces. The vanes may be of increasing thickness towards their outer ends to create the convergent spaces, or a cover plate may have a sloping inside surface to accomplish the space convergency.

4 Claims, 5 Drawing Sheets

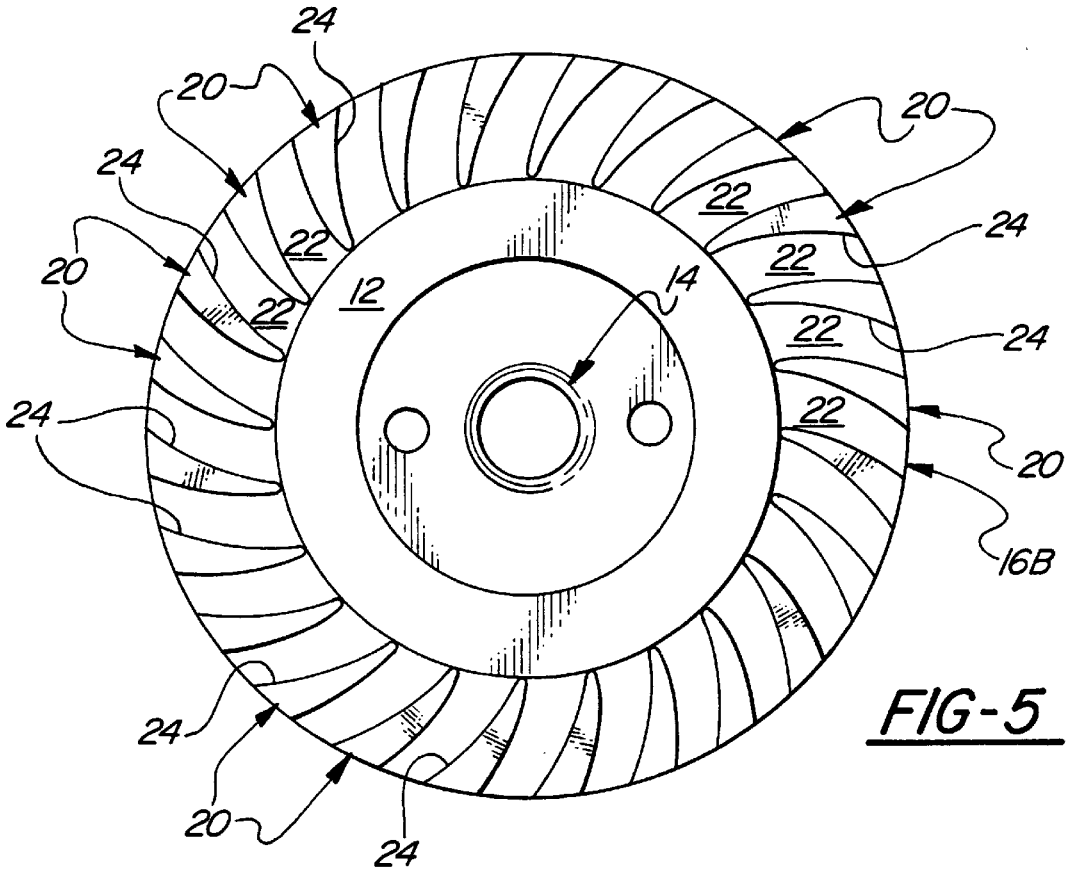
FIG-5
FIG-6
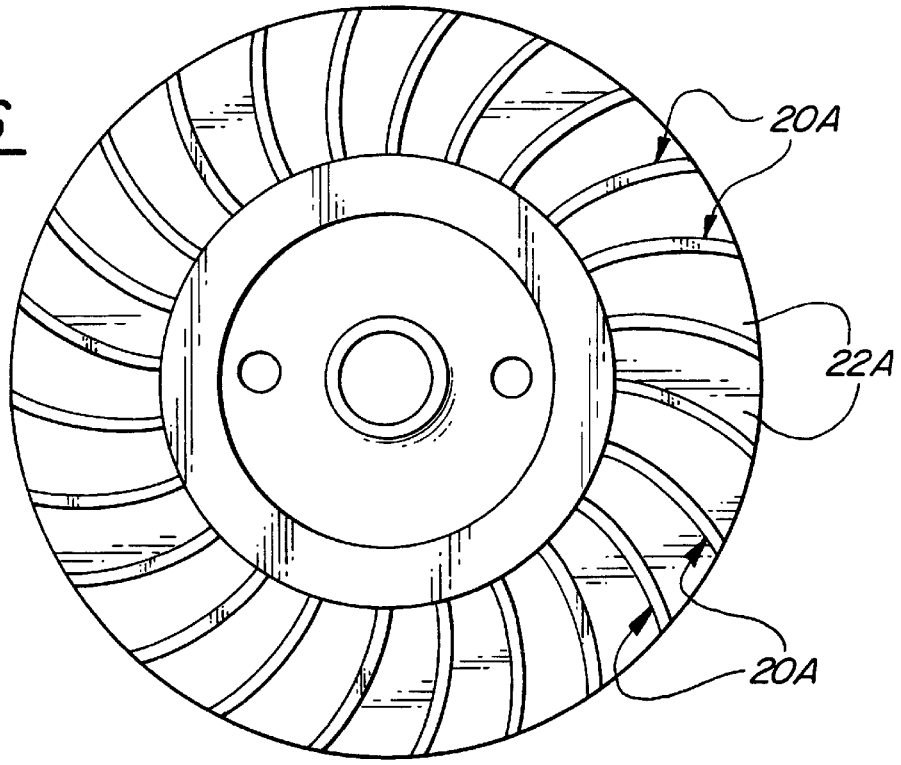

HIGH EFFICIENCY PUMP IMPELLER

CROSS REFERENCE TO RELATED APPLICATION

This application claims the benefit of U.S. Provisional Application No. 60/107,195 filed on Nov. 5, 1998.

BACKGROUND OF THE INVENTION

This invention concerns pumps and more particularly impellers for non positive displacement pumps.

A particular type pump impeller which has long been known is comprised of a stack of spaced apart discs. This type of pump uses a boundary layer effect causing a boundary layer adhesion of the fluid to the disc faces to cause liquid to be pumped upon rotation of the impeller, creating pressure and flow at an outlet in an enclosing pump housing.

Another well known impeller configuration has a series of radially extending vanes, which accelerate the fluid by directly acting on the fluid with the faces of the vanes as the impeller rotates.

The spaced disc impellers have the advantage of largely eliminating the low pressure regions and cavitation characteristic of vane pumps. Disc impellers also are more efficient in pumping viscous fluids and can pump fluids having entrained abrasives with less impeller wear.

On the other hand, the induced flow rate per unit area of the discs is low, and reduced efficiency is encountered in this type of impeller at high flow rates.

Turbulence and cavitation can still occur as the fluid exits the outer perimeter of the disc and flows into the volute space in a confining housing. Further, there is a tendency for adhesion of the fluid to the outer perimeter of the discs to create turbulence and thereby reduce the efficiency of the pump.

It has been heretofore been proposed to combine a vaned and spaced disc impeller, see U.S. Pat. No. 4,255,081 issued on Mar. 10, 1981 for a "Centrifugal Pump".

This combination is intended to provide most of the advantages of both types of impellers.

However, cavitation may still occur of the outer ends of the vanes and turbulence in the regions beyond the impeller perimeter.

It is the object of the present invention to provide an improved pump impeller of a hybrid vane-disc type in which the tendency for cavitation is greatly reduced and which operates more efficiently than prior designs.

SUMMARY OF THE INVENTION

The above recited object and others which will become apparent upon a reading of the following specification and claims are achieved by combining a multiple disc impeller with a series of radial vanes defining intervening flow spaces which are convergent in a direction towards the outer perimeter of the impeller. This convergency has been found to minimize the tendency to cavitate by eliminating regions of low pressure as the fluid flow exits those spaces.

The vanes terminate at a relatively steep angle to the outer circumference so that flow is directed substantially radially outward when emerging from the convergent intervening spaces to reduce the adhesion tendencies.

The convergency is created in one embodiment by an increasing vane thickness to a maximum at the outer ends, which shape causes a decreasing flow space cross sectional area to a minimum area at the impeller perimeter spaces. In another embodiment, a cover sidewall is tapered to create the convergency of the flow spaces.

The disc stack may extend into the vane area, or may be confined within an inner diameter of the impeller.

Another improvement is in the scalloping of the outer edge of the discs between the ends of the vanes, which scalloping also contributes to a smooth nonturbulent transitional flow from the impeller perimeter into the pump housing.

In one version, the impeller may also have only a single cover plate, to simplify and lower the cost of manufacturing the impeller.

DESCRIPTION OF THE DRAWINGS

FIG. 5 is an end view of the embodiment of FIGS. 1 and 2, with the end plate removed.

FIG. 6 is an end view of another form of the impeller of FIG. 1.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
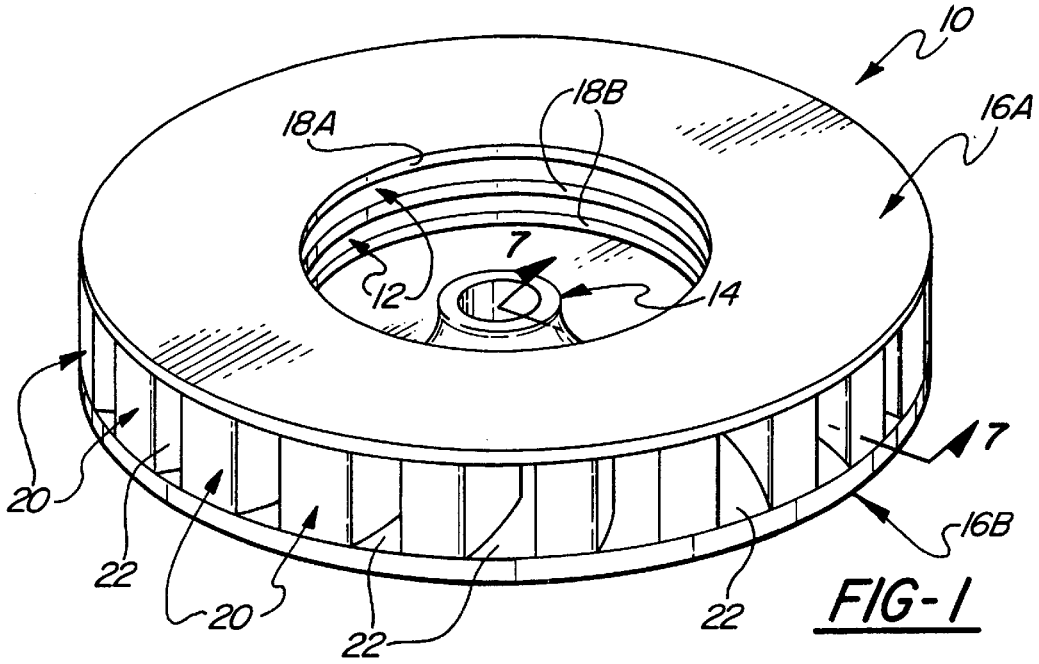
FIG. 1 is a perspective view of a first embodiment of the hybrid impeller according to the present invention.
Figure 2:
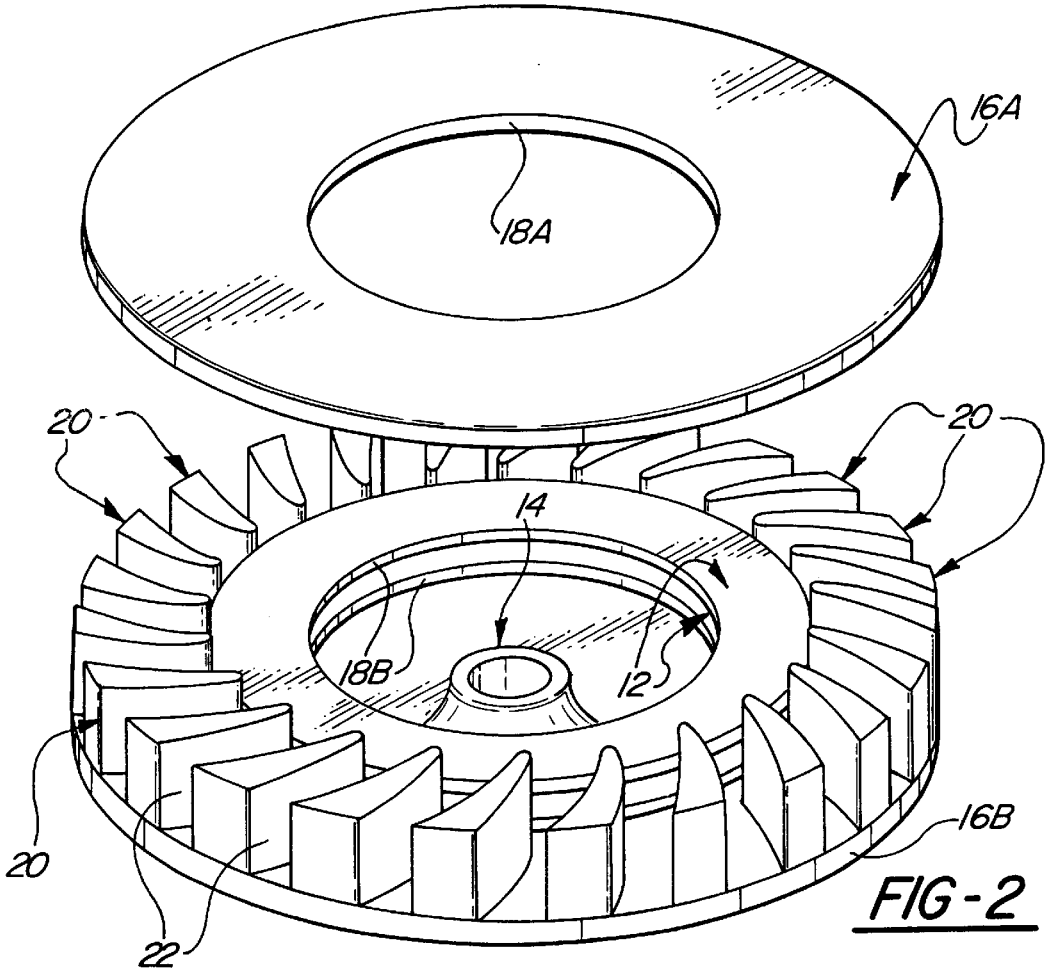
FIG. 2 is a perspective view of the impeller shown in FIG. 1 with one cover plate removed.

Referring to FIG. 1, a first embodiment of the hybrid pump impeller 10 is shown, which includes a series of spaced apart annular discs 12 in the inner region adjacent a hub 14 adapted to be fixed on a driving shaft (not shown). A pair of cover pieces 16A, 16B overlie each side of the impeller 10, cover piece 16A having an opening 18A aligned with openings 18B of the discs 12. The inner areas of the cover pieces 16A, 16B also act as a boundary layer discs 12 to establish a radial fluid flow upon rotation of the impeller 10 when fluid is supplied into the area within the diameter 18 defined by discs 14 and cover piece 16A.

Surrounding the outer perimeter of the discs 14 is a circumferential array of curved vanes 20, extending in a primarily radial direction to intersect the outer perimeter at a steep angle rather than to be curved into tangentially.

Figure 7:
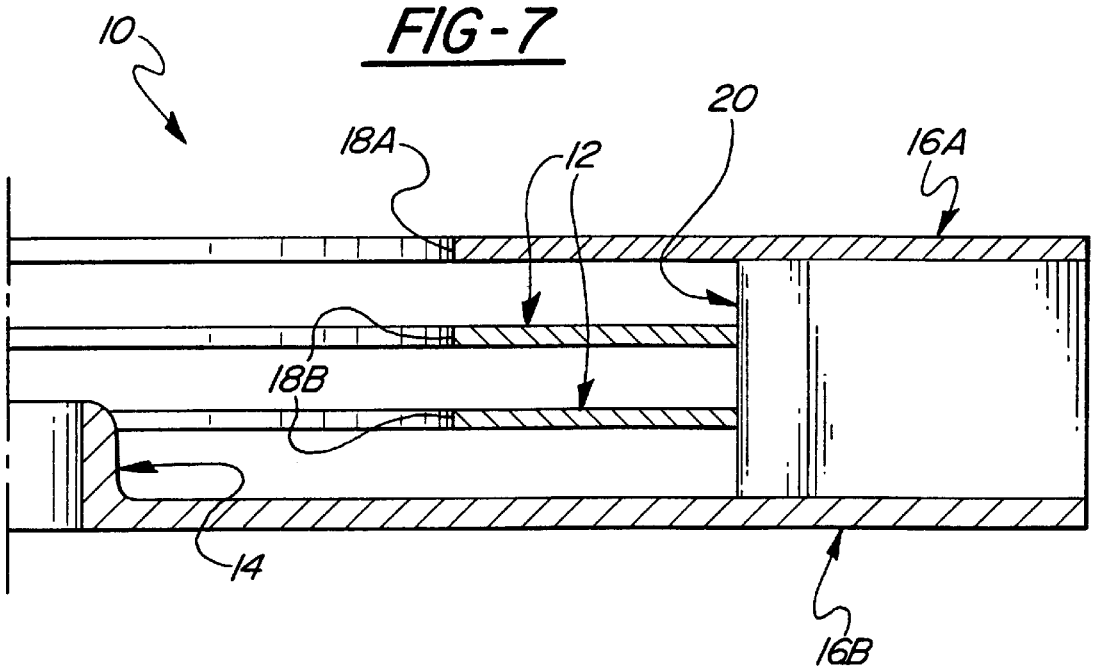
FIG. 7 is a view of the section 7—7 in FIG. 1.

Each of the vanes 20 is tapered so as to be of increasing thickness, measured in a circumferential direction, along its length in a radially outward direction (see FIG. 7). The inversely tapered shape of the vanes 20 creates convergent flow spaces 22 receiving the fluid flow created by rotation of the discs 14.

The radially extending concave surfaces 24 of the vanes 20 creates a pumping action due to the reaction of the fluid against the surfaces in the well known manner.

It has been found that the convergent space vane pumping action combined with the multiple disc pumping action produces a highly efficient high capacity pumping action having the advantages of both types of pump.

The convergency of the spaces has been found to minimize any tendencies for cavitation which otherwise would be present.

The vanes 20 extend at a steep angle to the outer perimeter, so that the spaces direct the fluid flow primarily radially outward when the fluid exits the spaces, efficiently directing the flow out into the volute space in the pump housing (not shown).

The impeller 10 can advantageously be molded from a suitable plastic material to reduce cost, weight and increase corrosion resistance. A suitable type of plastic is polyphenlene sulfide.

In this embodiment the multidisc and vane impeller stages are in series, with the vanes 20 arranged around the outer perimeter of the discs 14.

It is also possible to extend the pumping discs radially outwardly into the vane area.

Figure 3:
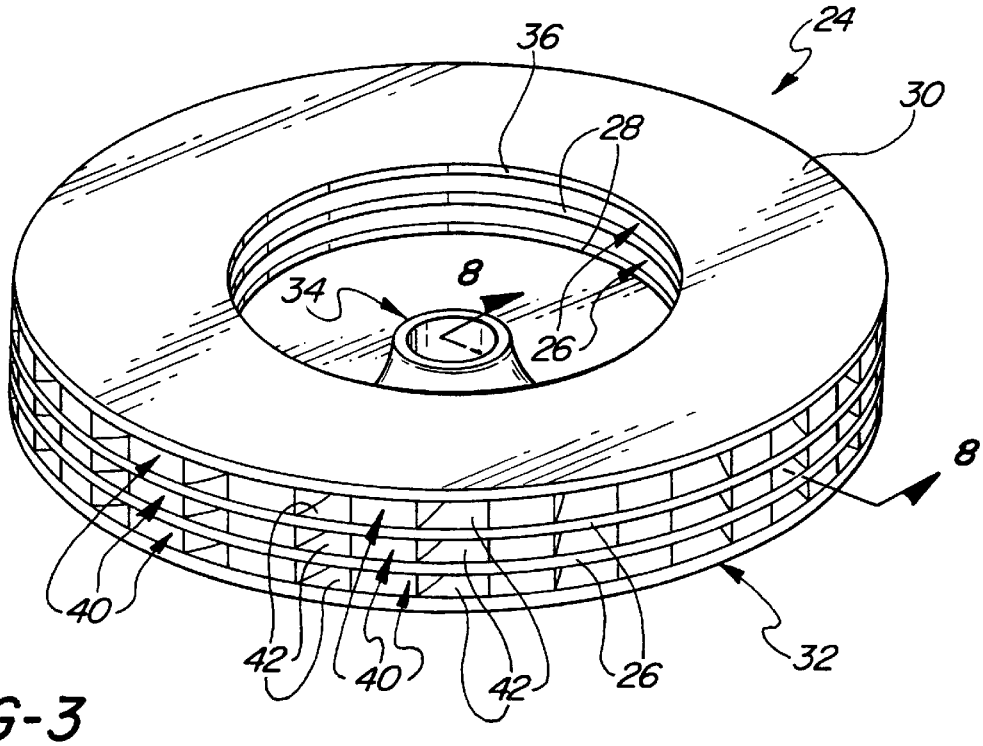
FIG. 3 is a perspective view of a second embodiment of the pump impeller according to the present invention.
Figure 8:
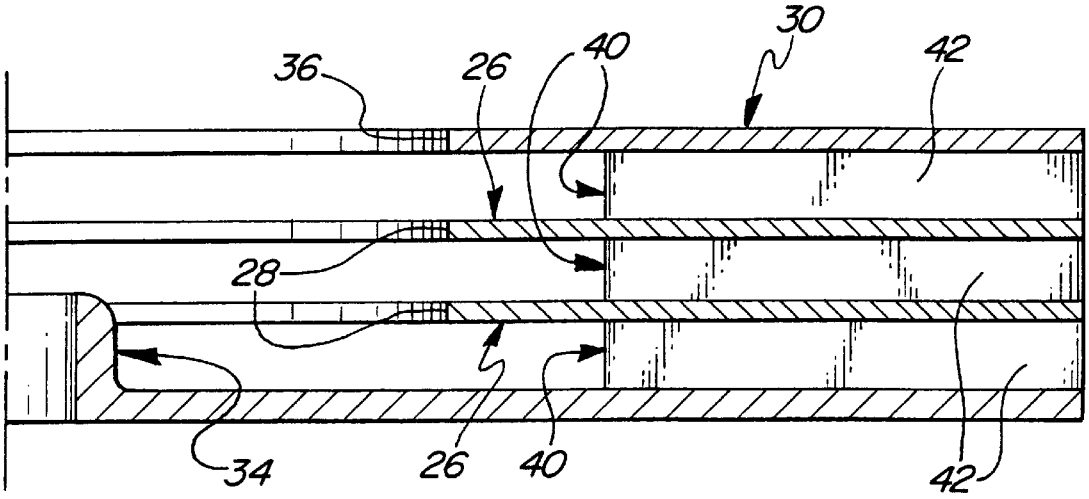
FIG. 8 is a view of the section 8—8 in FIG. 3.
Figure 9:
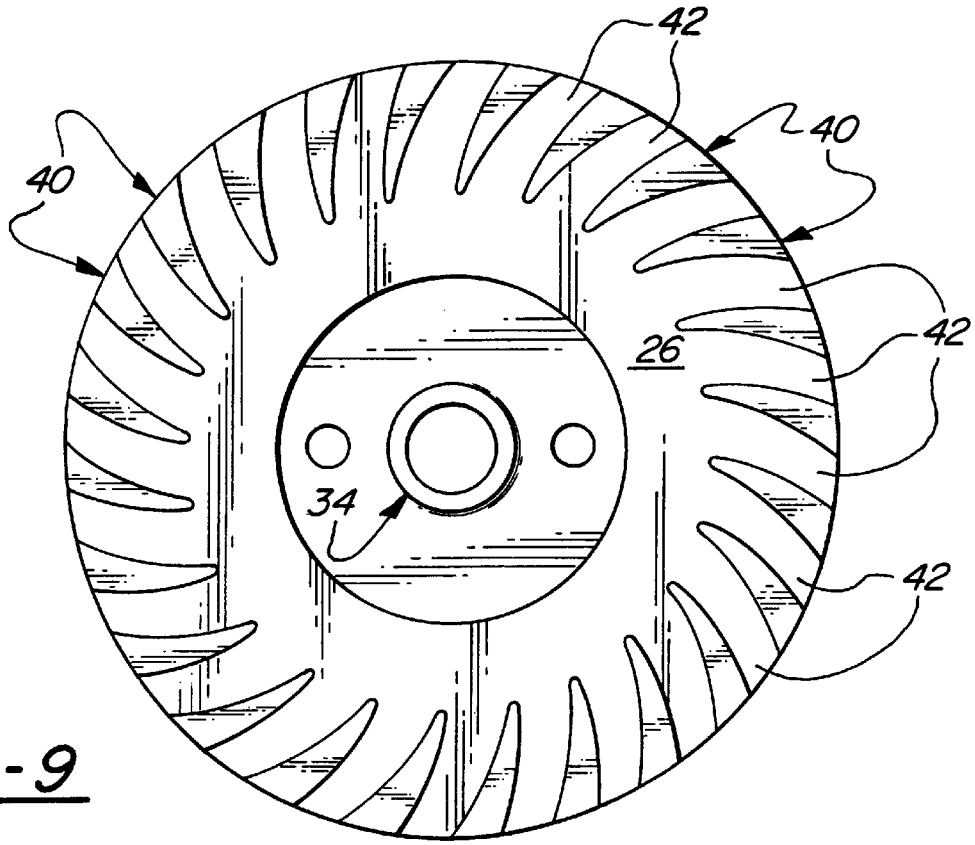
FIG. 9 is an end view with a cover plate removed of the impeller shown in FIG. 3.
Figure 10:
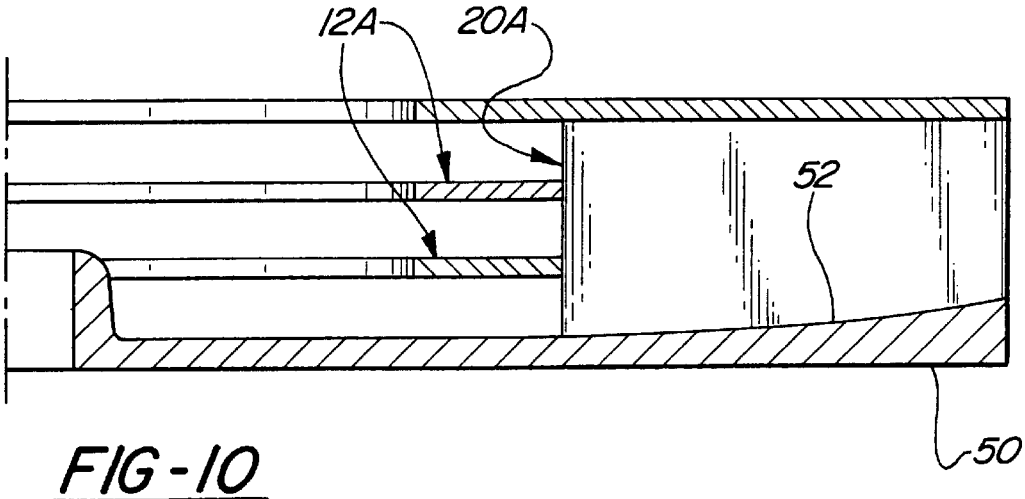
FIG. 10 is a sectional view of the impeller of FIG. 10.

This is incorporated in the second embodiment shown in FIGS. 3, 8 and 9. In this impeller 24, the annular discs 26 extend radially out from the inner diameter 28 to the outside perimeter of the impeller 24, as do cover discs 30, 32. The cover disc 32 has a hub 34 for attachment to a driving shaft (not shown), while cover disc 30 has an inner opening 35 aligned with the inner diameter 28 of the annular discs 26, fluid entering the opening 38 created by the annular shape of discs 26 and cover 30.

A series of aligned arrays of vane 40 extend through the spaces between each of the discs 26 and covers 30, 32. The curved shape vanes 40 extend radially to the outer perimeter of the impeller 24.

The vanes 40 are tapered to increase in width towards their outer ends, creating intervening 42 spaces 42 which are of decreasing cross-sectional area along the radial direction to achieve the advantages described above.

Both vane and boundary layer pumping action occurs through the spaces 42.

Figure 4:
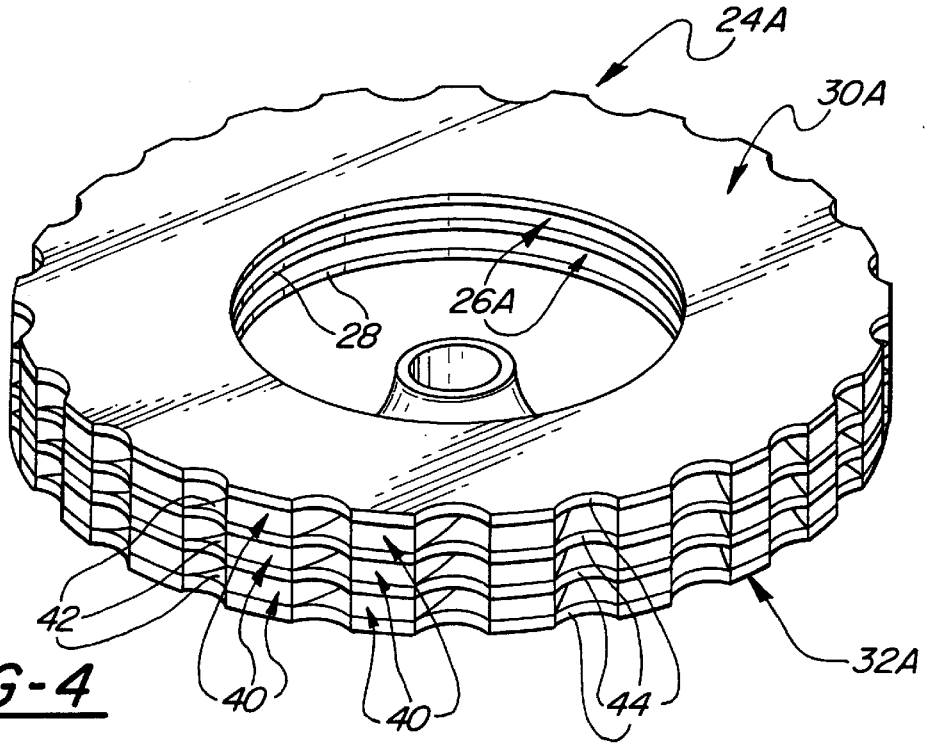
FIG. 4 is a perspective view of a modified form of the second embodiment.

A further improvement is shown in FIG. 4, where a series of scallops 44 are formed in the outermost perimeter of the covers 30A, 32A, and discs 26A aligned with opening 42 and in between the outer ends of the vanes 40. This has been found to reduce adhesion of the fluid and to aid in causing the pumped fluid to more readily escape the perimeter of the impeller 24A.

FIGS. 6 and 11 show another form of the impeller of FIG. 1, in which untapered vanes 20A are provided. In this configuration, the spaces 22 are converged by a sloping side wall 52 defined the inside surface of the cover 50.

Accordingly, an improved pump impeller is provided for obtaining a high efficiency pumping action and with the other advantages described.

What is claimed is:

1. A pump impeller comprising:

a stack of annular discs aligned on a common axis, said discs spaced apart axially to define interdisc spaces and said discs having a central opening allowing flow of fluid into said interdisc spaces defined between adjacent discs in said stack;

at least one cover plate disposed on one side of said stack of discs;

a circumferential array of radial vanes in each interdisc space extending radially outwardly to intersect the outer perimeter of said discs at a steep angle, said vanes spaced apart to define radially extending flow spaces within said interdisc spaces of a convergent shape, being of decreasing cross sectional area in a radially outward direction, whereby both boundary layer and vane pumping action can occur through said flow spaces and said fluid is expelled from said impeller through said minimum cross sectional areas of said flow spaces.

2. The impeller according to claim 1 wherein said vanes are of increasing thickness in a radially outward direction, said increasing vane thickness decreasing in area of said spaces.

3. The impeller according to claim 1 wherein said discs are scalloped around the outer perimeter thereof in areas between said vanes.

4. The impeller according to claim 3 wherein another cover plate is provided, aligned with said one cover plate and together axially enclosing said stack of annular discs and said vanes.

* * * * *